US006427239B1

(12) United States Patent
Worden

(10) Patent No.: US 6,427,239 B1
(45) Date of Patent: Aug. 6, 2002

(54) WEIGHT DISTRIBUTING KNEE PAD

(76) Inventor: Michael Worden, 1339 S. Sunset Dr. #7, Tempe, AZ (US) 85281

( * ) Notice: Subject to any disclaimer, the term of this patent is extended or adjusted under 35 U.S.C. 154(b) by 0 days.

(21) Appl. No.: 09/898,999

(22) Filed: Jul. 3, 2001

(51) Int. Cl.[7] ..... A41D 13/00
(52) U.S. Cl. ..... 2/24; 2/22
(58) Field of Search ..... 2/22, 24, 911, 2/16, 455; 128/881, 882; 602/26, 62, 63

(56) References Cited

U.S. PATENT DOCUMENTS 4,306,315 A * 12/1981 Castiglia ..... 2/22
4,803,975 A 2/1989 Meyers
5,301,370 A * 4/1994 Henson ..... 2/22
5,537,689 A 7/1996 Dancyger
5,561,857 A * 10/1996 Hoshizaki et al. ..... 2/22
5,662,594 A * 9/1997 Rosenblatt ..... 602/16
D385,670 S 10/1997 Oetting
5,732,411 A * 3/1998 Coleman et al. ..... 2/22
5,870,774 A 2/1999 Legenstein
D407,859 S 4/1999 Rule
D426,678 S 6/2000 Rule
6,070,267 A 6/2000 McKewin
6,178,556 B1 1/2001 Foreman et al.
6,256,787 B1 * 7/2001 Tyler ..... 2/22

* cited by examiner

*Primary Examiner*—Gloria M. Hale
*Assistant Examiner*—Tejash Patel
(74) *Attorney, Agent, or Firm*—Frank J. McGue

(57) ABSTRACT

A kneepad is disclosed which includes a lower leg support adapted to closely engage a lower leg of a user and a knee cover which conforms to the shape of a knee but is physically separate therefrom. A curved portion connects the lower leg support and the knee cover. A strap is included which is adapted to engage an ankle of a user.

7 Claims, 5 Drawing Sheets

FIG. 3A
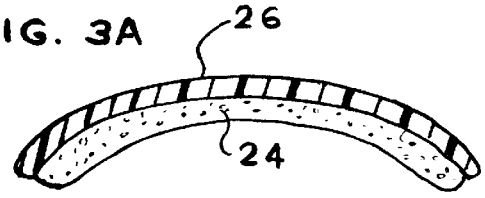
FIG. 3B
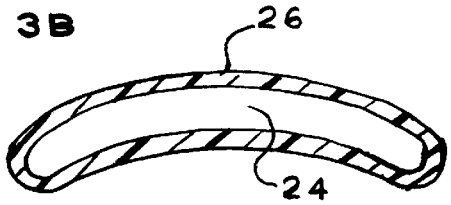
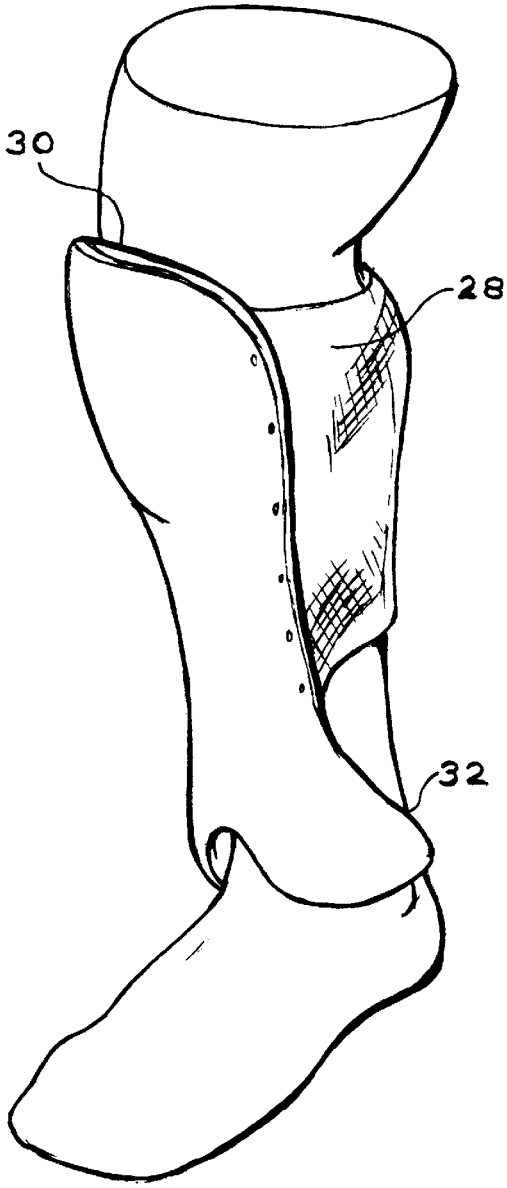
FIG. 4
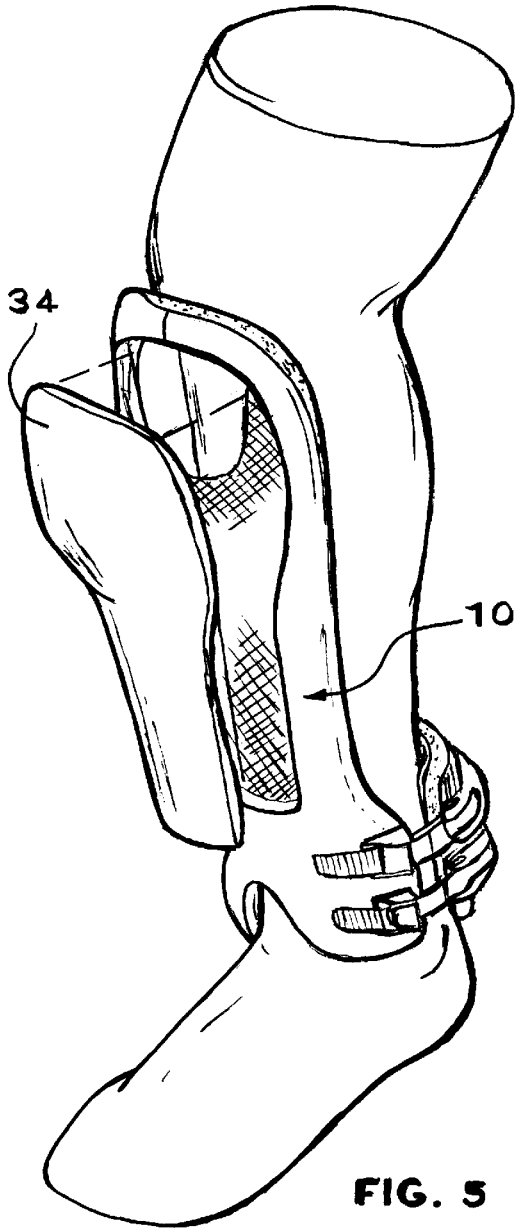
FIG. 5

WEIGHT DISTRIBUTING KNEE PAD

TECHNICAL FIELD

This invention relates in general to knee pads, and, more particularly, to knee pads which distribute weight along the lower leg for comfort and ease of use.

BACKGROUND OF THE INVENTION

A number of knee pads are currently on the market. However, such knee pads are not generally very comfortable, particularly for those who use such pads frequently during the day. One such class of individuals are carpet layers who may spend a majority of their time on their knees installing that material.

The problem in the usual knee pad is caused by the patella pushing against the femur which, in addition to simple discomfort, can result in damage to the skin, nerves, muscles, articular cartilage and bone. The usual knee pads also often bind behind the knee joint which reduces blood flow thereto and air circulation therethrough.

Thus, there is a need for a knee pad which prevents the patella from pushing against the femur and does not bind behind the knee. The present invention has met this need.

U.S. Pat. No. 5,537,689 entitled "Protective Kneepad Having a Single Piece Cupping Means and Stitch Receiving Groove" which issued on Jul. 23, 1996 to Dancyger and U.S. Pat. No. 6,178,556 entitled "Custom-Fitted Catcher's Leg Guard and Method" which issued on Jan. 30, 2001 to Foreman et al. disclose knee protectors which accommodate the knee and shin. However, none of the known prior art discloses the combination set forth herein.

SUMMARY OF THE INVENTION

It is an object of this invention to provide a knee pad which prevents the patella from pushing against the femur.

It is a further object of this invention to provide a knee pad which does not bind behind the knee.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which:

FIG. 3A is a cross sectional view of the embodiment of FIG. 1 taken along line 3—3;

FIG. 3B is a cross sectional side view of an alternate embodiment of FIG. 1 taken along line 3—3;

FIG. 4 is a perspective view of an alternate embodiment of the present invention using a leg cover;

FIG. 5 is a perspective view of an alternate embodiment of the present invention using a cover and a fabric support piece;

DESCRIPTION OF THE PREFERRED EMBODIMENT

Figure 1:
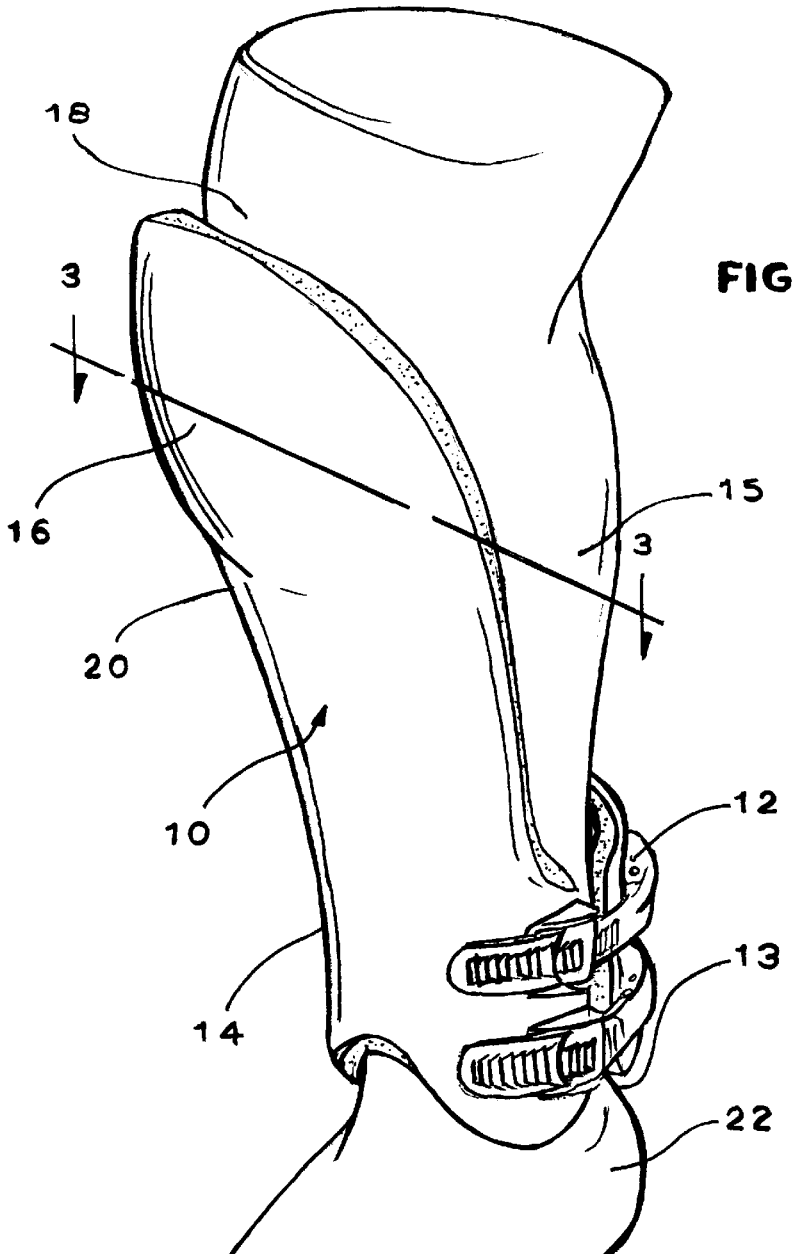
FIG. 1 is a perspective view of one embodiment of the present invention affixed to a knee of a standing user.
Figure 2:
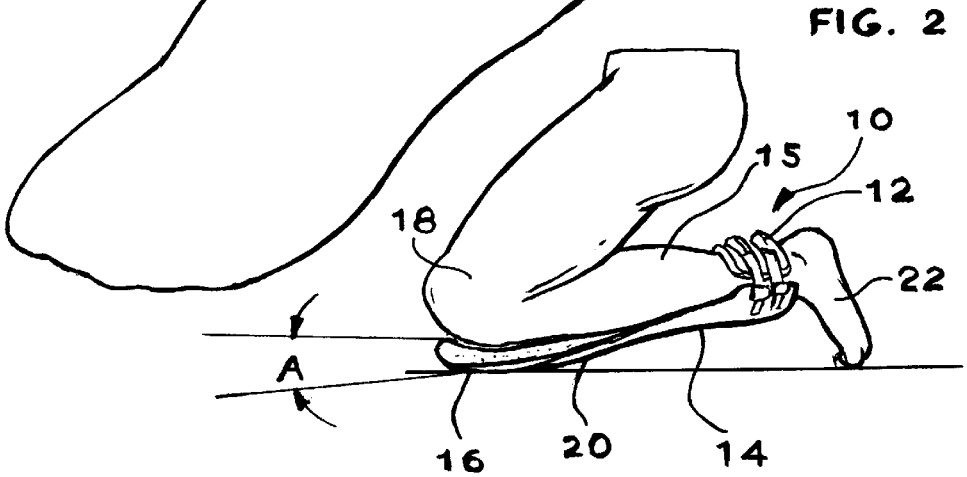
FIG. 2 is a side view of the embodiment of FIG. 1 affixed to a knee of a user in the kneeling position.

Referring to FIGS. 1–2, a typical embodiment of the present invention is shown. Kneepad comprises a strap 12 adapted to engage an ankle 13 of a user, a lower leg support 14 adapted to closely engage the front or shin of a lower leg 15 of a user and a knee cover 16 generally conforms to the shape of the front of a knee 18 but is physically separated therefrom by a curved portion 20. Lower leg support 14 and knee cover 16 are connected via a curved portion 20. Curved portion 20 extends upwardly and outwardly away from lower leg support 14 at angle A from a line defined by lower leg 15 and knee 18 thereby providing the physical separation between knee cover 16 and knee 18.

As best seen in FIG. 2, when a user kneels, that user's weight is supported more by the lower leg support 14 than knee cover 16. The weight is ultimately transmitted through kneepad to the ground via a foot 22 of the user and knee cover 16. However, there is only minimal or marginal contact by knee 18 with kneepad 10. Thus, kneepad 10 eliminates direct knee pressure and distributes that weight all along lower leg 15 of the user by means of cantilever action.

In one embodiment, kneepad 10 components curved portion 20, knee cover 16 and lower leg support 14 are integrally formed. As best seen in FIG. 3A, kneepad 10 is preferably made with a rigid structure 26 using material having enough rigidity to hold shape when a user kneels as shown in FIG. 2. Such materials include, but are not limited to, plastics, nylon, steel, carbon fiber, urethane, fiberglass and kevlar.

A padding 24 covers rigid structure 26 for comfort and thus is made from materials which are soft and pliable. Such materials include, but are not limited to, cloth, forms of ethylene vinyl acetate, foam, plastics, rubber, urethane, air or gas bladders, gel bladder or stretched nylon. Padding 24 can be affixed, bonded, stitched, riveted, glued or attached to via receiving slots, or by any other methods known in the art, to structure 26 for replaceability. Further, the thickness of padding 24 can vary depending on the load expected. Padding 24 also can employ differing materials on the exterior of kneepad 10 more suitable for engagement with flooring and the interior of kneepad 10 which is more suitable for engagement with a leg. Further, in one embodiment, kneepad 10 is provided with air holes to allow ventilation to reach the skin for cooling purposes.

Figure 6:
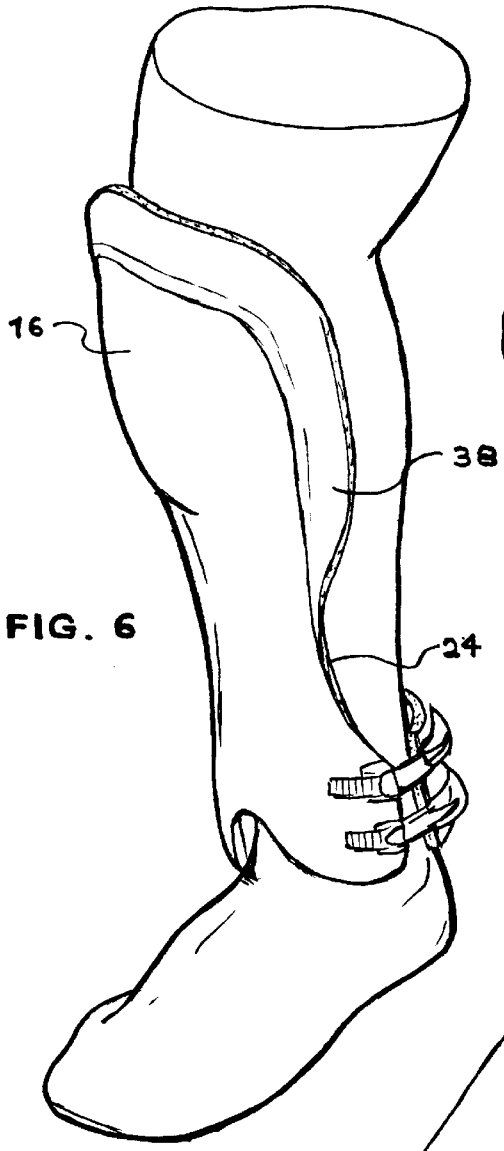
FIG. 6 is a perspective view of an alternate embodiment of the present invention using a debris ridge.

In a variation best seen in FIG. 4, kneepad 10 can be provided with a leg cover 28 which functions much like a sock, being made of a stretchable material. Leg cover 28 extends over kneepad 10 and, via stretchable openings 30 and 32 engage the leg of a user. Use of leg cover 28 is warranted when debris exists which can get between kneepad 10 and the user's leg, thereby causing discomfort when kneeling. As an alternative to leg cover 28, a debris ridge 38 extending inwardly from the distal end of knee cover 16 towards knee 18 is employed as best seen in FIG. 6. Debris ridge 38 can be integral with padding 24 or may be a separate piece attachable by hook and loop fasteners, snap fit fixtures, or any other suitable means.

Alternatively, a kneepad cover 34 is shown in FIG. 5 which extends only over kneepad 10, not both kneepad 10 and the leg. Kneepad cover 34 is useful for added protection in hard ground areas such as concrete or steel surfaces or in difficult environments such as when welding or for additional softness when working on delicate surfaces such as softer floor tiles or lightly colored carpets. Thus, kneepad cover 34 is made from a variety of materials depending on the particular purpose therefore. Kneepad cover 34 can be made of steel or metal for welding, carbon fiber or plastic for hard ground, or cloth or leather for delicate surfaces. Kneepad cover 34 is attachable via any of the well known methods in the art such as, but not limited to, double faced tape, hook and loop fasteners, glue or snap in technology. Such methods are well known in the art and will not be further discussed herein.

Straps 12 which secure kneepad 10 at ankle 13 use any of the well known methods in the art such as, but not limited to, plastic buckles, wire buckles, hook and loop fasteners, elastic bands or snap fit fixtures. Alternative embodiments employ hinged sections or have more than one opening. Such methods are also well known in the art and will not be further discussed herein.

Figure 7:
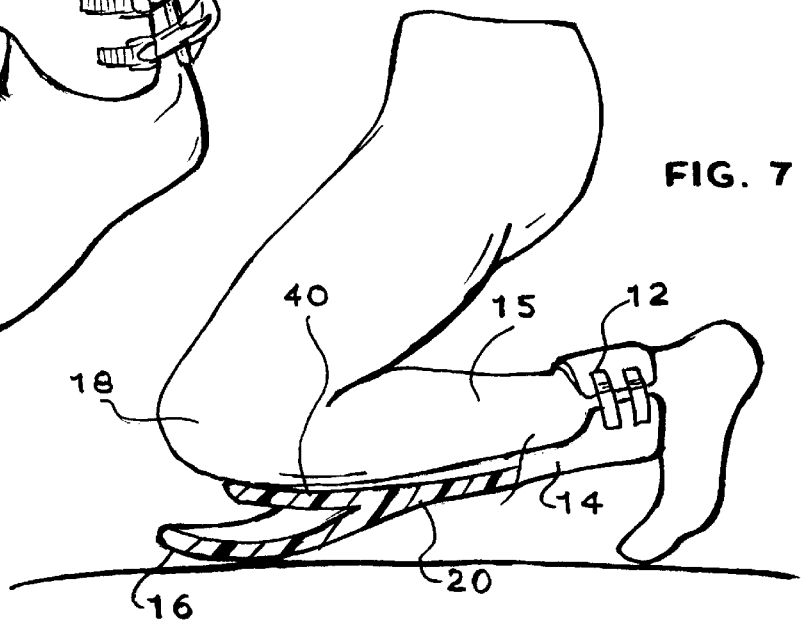
FIG. 7 is a partial cross sectional side view of an embodiment using a secondary ridge.

In an alternate embodiment depicted in FIG. 7, additional support may be provided by the addition of a secondary ridge 40 positioned at the junction between lower leg support 14 and curved portion 20 extending inwardly towards knee 18. Secondary ridge 40 provides additional support for lower leg 15.

Figure 8A:
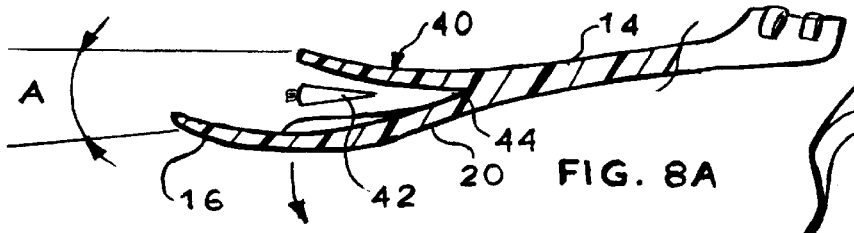
FIG. 8A is a cross sectional side view of an embodiment using a secondary ridge and a shim.
Figure 8B:
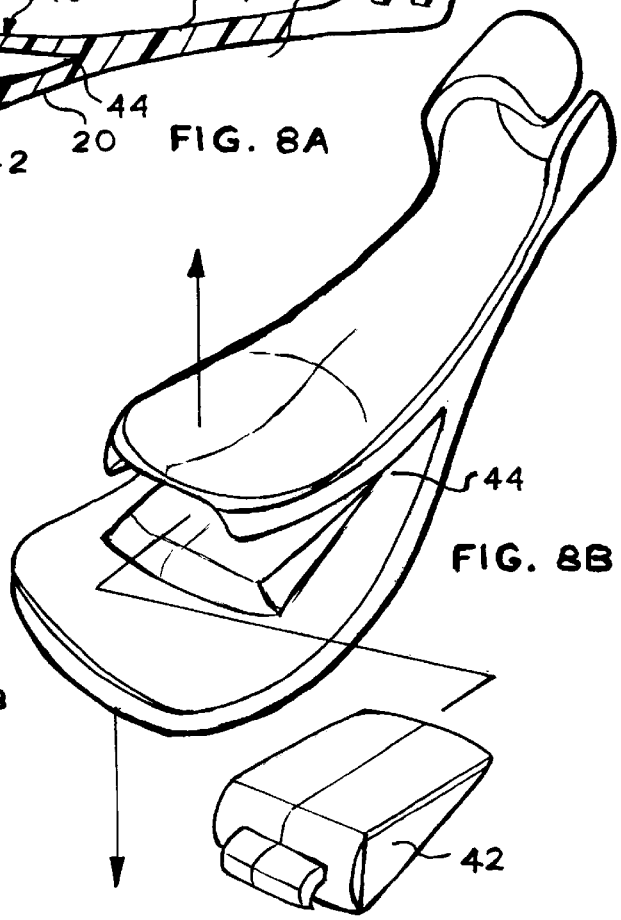
FIG. 8B is a perspective exploded view of an embodiment using a secondary ridge and a shim with a compression piece.

In a further variation of secondary ridge 40 as seen in FIGS. 8A and 8B, a cone shaped shim 42 or the like is provided which mates with corresponding opening 44 between secondary ridge 40 and curved portion 20. Moving shim 42 in or out allows a user to adjust angle A between lower leg support 14 and knee cover 16 as desired for comfort and the height which best conforms to the user's needs.

Figure 9:
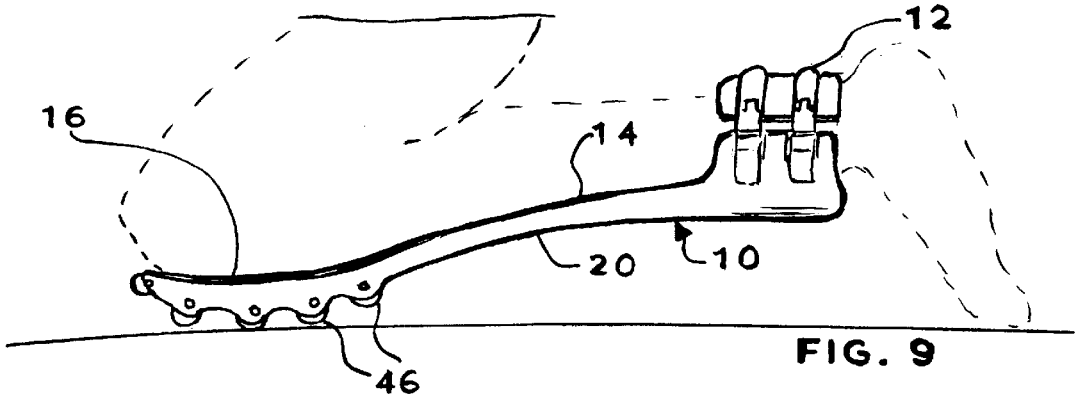
FIG. 9. is a cross sectional side view of an embodiment using one or more rollers.
Figure 10:
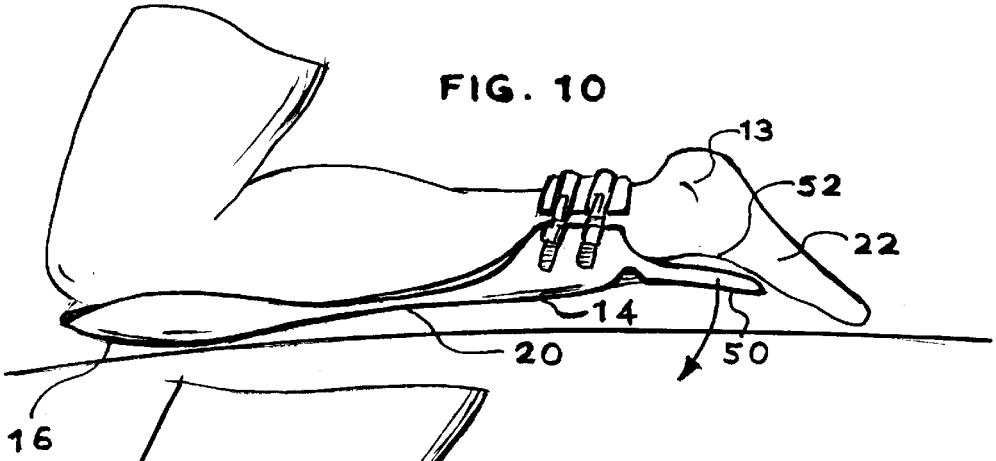
FIG. 10 is a partial cross sectional side view of an embodiment using a foot piece.
Figure 11:
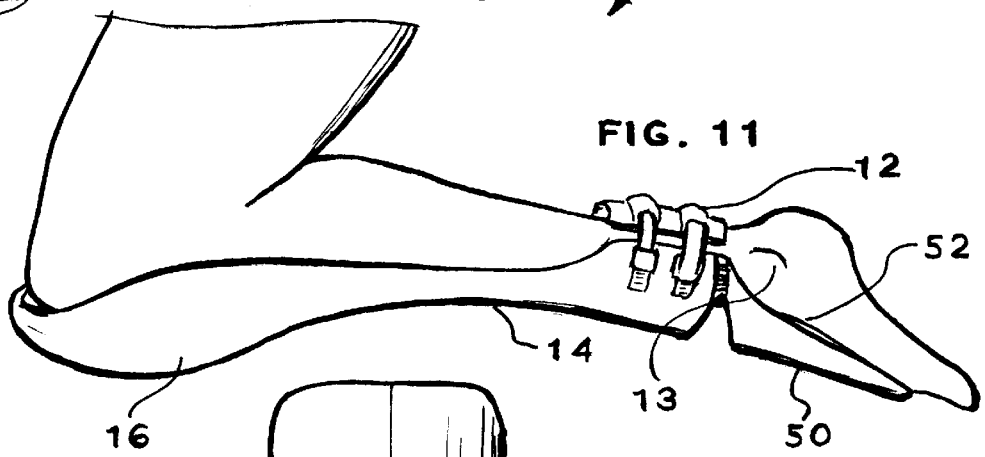
FIG. 11 is a partial cross sectional side view of an embodiment using an alternative foot piece.

Still another variation is shown in FIG. 9 in which the exterior of knee cover 16 is provided with one or more rolling devices 46 to allow a user to more easily move about the ground on hands and knees by reducing floor drag. One or more rolling devices 46 also prevents snagging and reduces wear on kneepad 10. Rolling devices 46 include, but are not limited to, rollers, balls, and ball bearings An alternate embodiment is depicted in FIGS. 10 and 11 whereby a foot piece 50 extends downwardly from lower leg support 14 along the top of a user's foot 52. This variation provides support for the foot and ankle. If foot piece 50 extends the length of a user's foot, as shown in FIG. 11, the user's weight can be completely supported by foot piece 50 and knee cover 16. In the shorter version of foot piece 50 depicted in FIG. 10, support is still provided to ankle 13 and foot 22.

Figure 12:
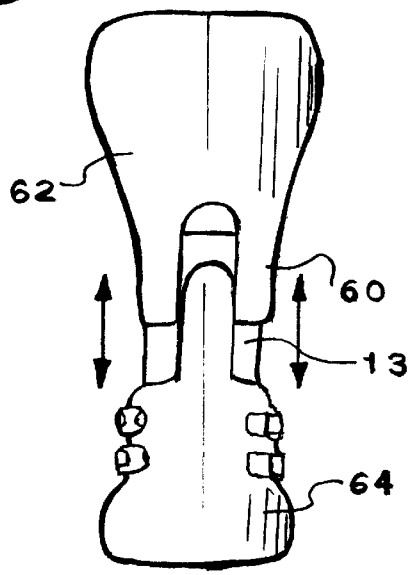
FIG. 12 is a front view of an embodiment using telescoping elements to adjust length.
Figure 13:
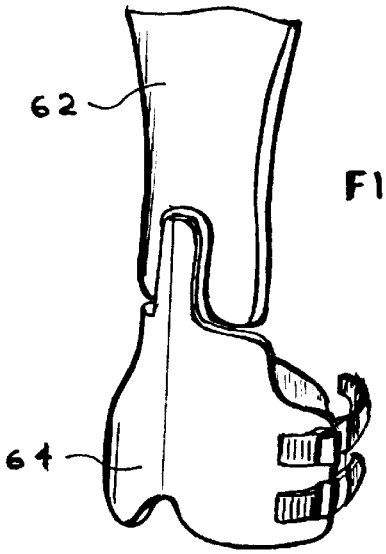
FIG. 13 is a perspective view of the embodiment of FIG. 12.

Kneepad 10 as heretofore described requires a multiplicity of sizes to accommodate the wide variations in the size of humans. An alternate embodiment depicted in FIGS. 12 and 13 provides a lower leg support 60 having a upper portion 62 which telescopes with a lower portion 64 to allow the user to adjust the length of kneepad 10. Once the user is satisfied, lower portion 64 and upper portion 62 are affixed relative to one another by a means such as, but not limited to, pins along the edge or the like. In addition to providing length adjustments, the embodiment of FIGS. 12 and 13 allows the substitution of differing portions 62 or 64 as desired. For example, differing angles A can be accomplished by appropriate substitutions of upper portion 62.

Figure 14:
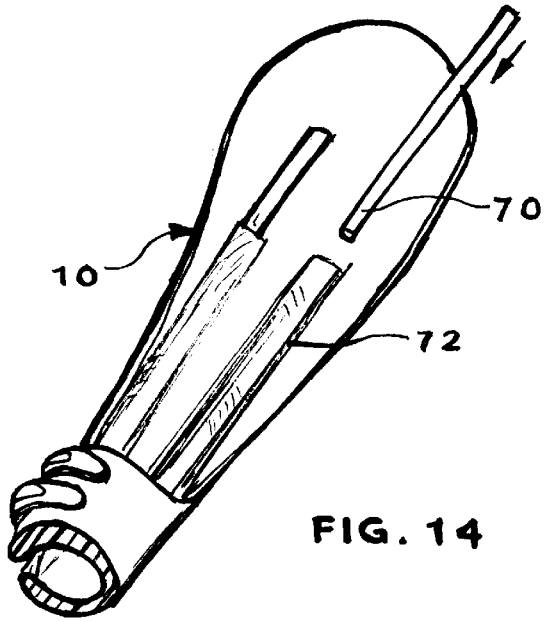
FIG. 14 is a rear view of an embodiment using support members.

As best seen in FIG. 14, for additional strength, support members 70 of varying materials and hardness can be inserted into corresponding channels 72 positioned on the interior of kneepad 10. Support members 70 can be removable as desired, or may be integral with kneepad 10.

Figure 15:
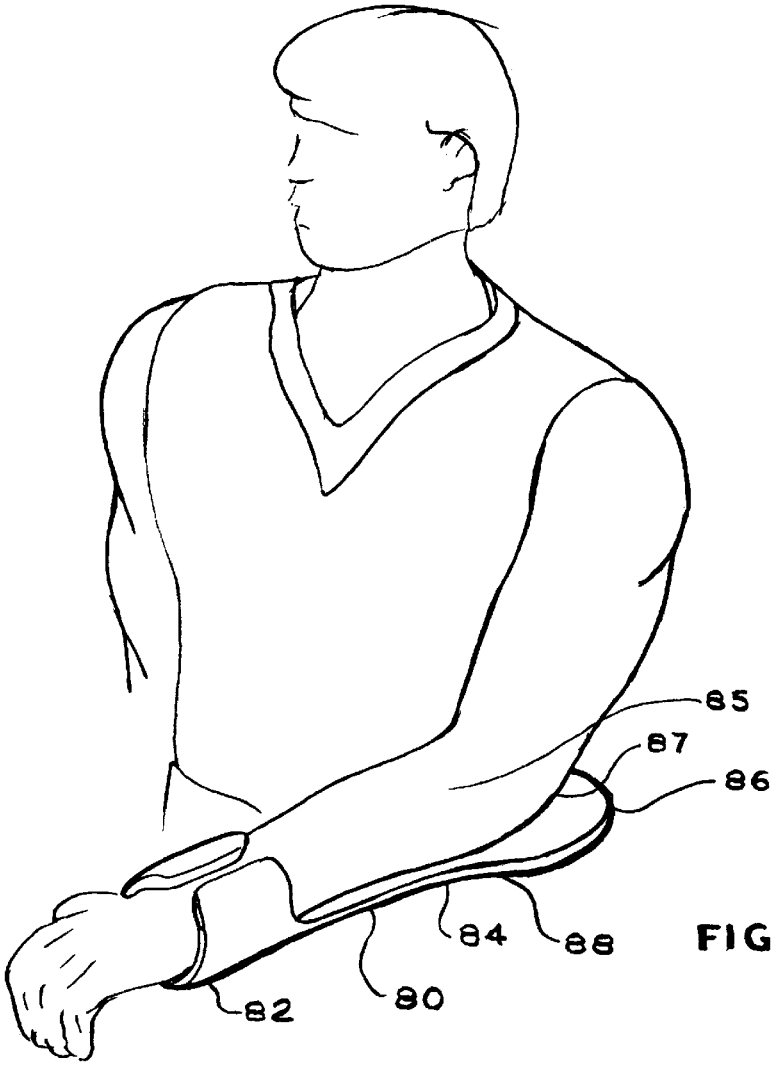
FIG. 15 is a partial cross sectional side view of an embodiment for use in connection with the elbow joint.

Lastly, the principles of the present invention are adaptable to other joints as best seen in FIG. 15 wherein an elbow support device 80 is provided with a wrist strap 82, a forearm support 84 adapted to engage a user's forearm 85, an elbow cover 86 extending over but not contacting a user's elbow joint 87 and a curved portion 88 joining forearm support 84 and elbow cover 86.

Although only certain embodiments have been illustrated and described, it will be apparent to those skilled in the art that various changes and modifications may be made therein without departing from the spirit of the invention or from the scope of the appended claims.

What is claimed is:

1. A weight distributing kneepad comprises a strap adapted to engage the ankle of the user, a lower leg support adapted to closely engage the front of the lower leg, a knee cover which conforms to the shape of the front of the knee but is physically separate therefrom and a curved portion which connects the lower leg support and the knee cover, the curved portion extending upwardly and outwardly away from the lower leg support at a sufficient angle from a line defined by the lower leg and the knee to provide physical separation between the knee cover and the knee.

2. The kneepad of claim 1 wherein the lower leg support, the knee cover and the curved portion are integrally formed.

3. The kneepad of claim 2 wherein the integrally formed lower leg support, the knee cover and the curved portion comprise a rigid structure comprises of a material having enough rigidity to hold shape.

4. The kneepad of claim 3 wherein a padding covers the rigid structure, the padding being made from a soft and pliable material.

5. The kneepad of claim 1 further comprising a leg cover, the leg cover being made of a stretchable material, the leg cover extending over the kneepad, the leg cover further having stretchable openings which are adapted to engage the leg of a user.

6. The kneepad of claim 1 further comprising a debris ridge extends inwardly from the distal end of the knee cover towards a knee.

7. The kneepad of claim 1 further comprising a kneepad cover which covers the lower leg support, the knee cover, and the curved portion.

* * * * *